United States Patent [19]

Pestel et al.

[11] Patent Number: 4,742,789

[45] Date of Patent: May 10, 1988

[54] METHOD AND APPARATUS FOR REGULATION OF SEAM SHAPE

[75] Inventors: Karl Pestel; Manfred Kraus, both of Karl Marx Stadt; Jürgen Waldmann, Berlin; Heinz Holzmann, Karl Marx Stadt, all of German Democratic Rep.

[73] Assignee: VEB Kombinat Textima, Karl Marx Stadt, German Democratic Rep.

[21] Appl. No.: 342,558

[22] Filed: Jan. 25, 1982

[30] Foreign Application Priority Data

Apr. 6, 1981 [DD] German Democratic Rep. ... 229017

[51] Int. Cl.[4] ..... D05B 19/00; D05B 27/10; D05B 35/10

[52] U.S. Cl. ..... 112/262.3; 112/153; 112/308; 112/121.11

[58] Field of Search ..... 112/121.11, 121.12, 112/308, 320, 322, 158 E, 262.3, 262.1, 153

[56] References Cited

U.S. PATENT DOCUMENTS

| | | | |
|---|---|---|---|
| 3,609,373 | 9/1971 | Desai et al. | 112/121.11 |
| 3,970,014 | 7/1976 | Chano et al. | 112/153 X |
| 4,100,865 | 7/1978 | Landau, Jr. et al. | 112/121.11 |
| 4,159,687 | 7/1979 | Masuda et al. | 112/153 X |
| 4,191,118 | 3/1980 | Blessing | 112/308 X |
| 4,226,197 | 10/1980 | Pollmeier et al. | 112/121.11 |
| 4,248,168 | 2/1981 | Hoffman | 112/153 X |
| 4,296,700 | 10/1981 | Jehle et al. | 112/153 |
| 4,359,953 | 11/1982 | Martell et al. | 112/121.11 |
| 4,398,348 | 8/1983 | Bergvall et al. | 112/121.11 X |
| 4,403,559 | 9/1983 | Hirose | 112/121.12 |

FOREIGN PATENT DOCUMENTS

| | | | |
|---|---|---|---|
| 1167636 | 4/1964 | Fed. Rep. of Germany | 112/121.11 |

*Primary Examiner*—Peter Nerbun

*Attorney, Agent, or Firm*—Jordan and Hamburg

[57] ABSTRACT

The invention relates to automatic sewing and/or joining of textiles, high polymer materials, leather and metals. The object of the invention is to automate the sewing opertion system, to improve the quality of the seam and to conserve labor. A self-regulating system has to be created. According to the invention, the sewing operation is carried out as a control process, in which the deviation of the produced seam shape from the stored seam shape serves as a control value for the transporting elements of the sewing goods. For this, one or a plurality of detection heads and light emitters are arranged in the area of the seaming point, and are connected to an information processing system. The seam shape initially arising is transformed into storable data, is stored together with other data of the seam, and the seam path arising from automatic sewing is compared with the stored data. Deviations from the desired seam path are at once automatically corrected. The invention may be used in the textile, leather, metal, and plastics industries.

14 Claims, 4 Drawing Sheets

METHOD AND APPARATUS FOR REGULATION OF SEAM SHAPE

BACKGROUND OF THE INVENTION AND PRIOR ART STATEMENT

The invention relates to the automatic sewing and/or joining of textiles, high polymer materials, leather and metals.

Technical solutions are known which make automatic sewing possible, wherein the sewing goods which are to joined, are guided along the seam point according to a desired geometric path. Two basic solutions prevail:

I. The sewing goods to be joined are rigidly clamped in a frame between plate chucks or similar elements, while the clamping element is moved underneath the seaming point according to the numerical web control.

Thus DE-OS No. 2629677 describes a numerically controlled sewing machine producing a seam in the sewing goods according to a sewing stencil. The innovation of this solution is that only a drawn stencil is handled by an optical scanning device with respective means, in such a manner that digital signals are obtained for the control of the stencil. Other devices (DE-OS No. 2313222 DD-WP No. 126881, U.S. Pat. No. 3,985,466, DE-OS No. 2826084 and U.S. Pat. No. 3,613,610) use punched tape or other recording carriers, carrying information. DE-OS No. 2557171 describes a device that accepts the sewing goods by a clamping device which photoelectrically scans the pre-basted edge of the sewing goods in the clamped position and thereby controls formation of an equidistant decorative strip.

II. The sewing goods to be joined are clamped either continuously or discontinuously in points and are guided under the seaming point with the aid of a guide edge and operating elements at suitable points for the transfer of the kinetic energy. Technical solutions according to this principle are described in DE-OS Nos. 2253990 and 2522422.

A series of technical solutions are known (DE-OS Nos. 2909664, 2907669, 2840048 and 2437777) which may be used according to their suitability, independent of the basic principle.

The disadvantage is that the known devices which rigidly clamp the sewing goods and guide the coordinated motions, although allowing a qualitatively perfect shape of the seam, require a high technical expense, for example a table which has to be moved following x- and y- coordinates.

The discontinuous sewing process is particularly disadvantageous because the sewing goods must be clamped onto the sewing goods carrier prior to sewing in front of the seaming point, and must be unfastened after sewing. This may only be improved by having a plurality of sewing goods carrriers in use, which increases the technical expense even more. The control of the motion of the sewing goods carrier occurs either in the traditional manner with the aid of stencils which are scanned either by mechanical, pneumatical or photoelectrical means or by being programmed with the aid of a CNC-control which controls the motional course of the drive elements of the sewing goods carrier.

The devices which guide the sewing goods with various elements under the seaming point without rigid clamping have the disadvantage that a deviation from the desired seam shape occurs between the drive elements for guiding and the seaming point due to the elastic nature of the sewing goods, and that the seam is reduced in quality. An additional disadvantage is that these devices mostly have a reduced field of application regarding the shape of the seam. The sewing machine cannot detect a deviation from the desired shape of the seam and cannot correct it.

The object of the invention is to automate the sewing process, to open new fields of use for automatic sewing, and to simultaneously improve the quality of the seam.

The economic effect is the saving of labor in the garment industry.

SUMMARY OF THE INVENTION

The object of the invention is the development of a program for the automatic sewing of any desired seam form by a self-regulating system in which the stored program data serve to regulate the shape of the seam in the continuous production operation. Furthermore, the sewing machine is provided with a device which stores the desired seam operation as data, detects the evolving seam shape, compares it with the stored seam shape and delivers signals to the regulating device in order to produce the required seam shape.

The object is accomplished according to the invention by conducting the sewing operation as a controlled operation. The data produced from the controlled operation serves as a control value for the transporting elements of the sewing goods. The seam shape, arising at first, is transformed into storable data and is stored together with other data for the number of stitches, the continuous path of the seam, and the like. The path of the seam arising from the automatic sewing is continuously compared to the stored data. In case of deviations, immediate automatic correction occurs, so that a uniform path of seam results. The sewing process is thereby accomplished as a self-regulating system. By comparing the resultant seam with a seam, previously produced according to optimal technical desires, a self-regulating system may be spoken of.

Without greatly varying conventional members used for the production of a seam, a detection head is positioned close to the seaming point at a small distance from the textile surface in such a manner that it does not impede the process of seam construction.

The deduction head, comprising, for example, a light source as a transmitter, a glass fiber system as an optical carrier, and solid state image sensors as receivers, based, for example, upon silicon or gallium arsenide, in addition to a more rational operating technique, also influences and thereby increases the accuracy of the sewing operation.

A recording unit is disposed within the detection head, said detection head preferably containing CCD-units in a matrix or line form by using solid state sensors. These electronic semiconductor components operate as photo-electrical receivers. They are connected to charge couple devices and allow an optical image to be resolved into image elements.

These original signals are reinforced and cyclically stored according to consecutive stitches in such a manner that they may be compared at once with signals already presented whereby the differences found therewith serve to control the seam paths.

A detection head may contain phototransistors. In this case, a body exhibiting a plane surface in the direction of the sewing goods, may be provided with small bores in a matrix shape. These boreholes are located at a distance from the seaming point and are provided with light cables which bring the light signals to a location where the phototransistors are arranged on a surface with larger dispersion. The end of the light conductor cable, pointing towards the surface of the sewing goods, is arranged at the end of a cylindrical borehole in the head, so that the light beam is directed.

The light emitters may be, as a rule, disposed above or below the sewing goods. The light emitters, when arranged above the sewing goods, are arranged to the right and to the left of the needle in such a manner that they irradiate light, preferably in the infrared or in the ultraviolet region, parallel to the textile surface. This light beam is reflected by the seam or edge of the sewing goods running parallel to it, and is observed by the detection head. Another technique for detecting the edge of the sewing goods, is by directing a shadow of the elevated edge of the sewing goods upon the underlying portion of the goods by obliquely incident light, whereby the position of the seam, which runs equidistantly to the edge of the sewing goods, is detected.

In order to be widely used in the garment industry, the light emitter may be disposed underneath the sewing goods, when the textile material is translucent. In this case, the edges of the sewing goods and the therewith present multiple layers of sewing goods cause differences in the intensity of light, which may be detected by a CCD-element, for example.

In a series of fields by use, an upper sewing thread may be used, which shines when irradiated with a specific light so that it may be detected.

The electrical signals are electrically processed in a known manner. Thus it is possible to store the signals and to compare them with stored signals. The observable geometric divergences and the concurrent change of the divergences are correspondingly processed (by a microcomputer, for example) and actuate the control of elements for transporting the sewing goods through amplification stages, whereby correction of the instantaneous seam shape is possible.

The solution according to the invention makes it possible to accept a technologically required seam shape of a sewing machine in digital signals and to use them for the control of the instantaneous seam path as well as to transfer the accepted digital signals to other sewing machines and also thereby exert a control of the instantaneous seam path.

In addition to the usual transporting means for transporting the sewing goods, pairs of clamping rolls may also be used which are driven by such motors, which allow a variable number of revolutions and which allow the requisite number of revolutions to be detected by a sensor when the sewing goods are manually guided. These requirements may be fulfilled, for example, by stepping motors.

BRIEF DESCRIPTION OF THE DRAWINGS

The invention is hereinbelow explained in detail by way of an example of an embodiment. In the attached drawings.

DETAILED DESCRIPTION OF PREFERRED EMBODIMENTS

Variant 1 refers to a double stitch sewing machine with nonvariable operating components.

Figure 1:
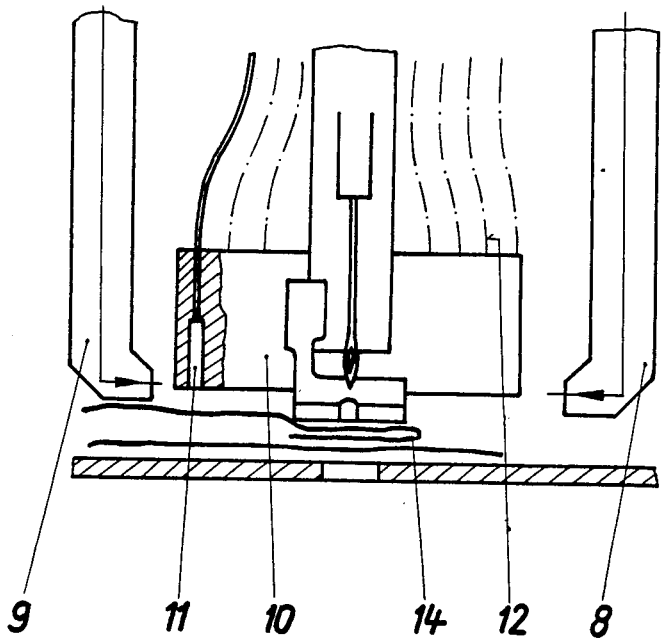
FIG. 1 is a front elevation view of the seaming point, variant 1.
Figure 2:
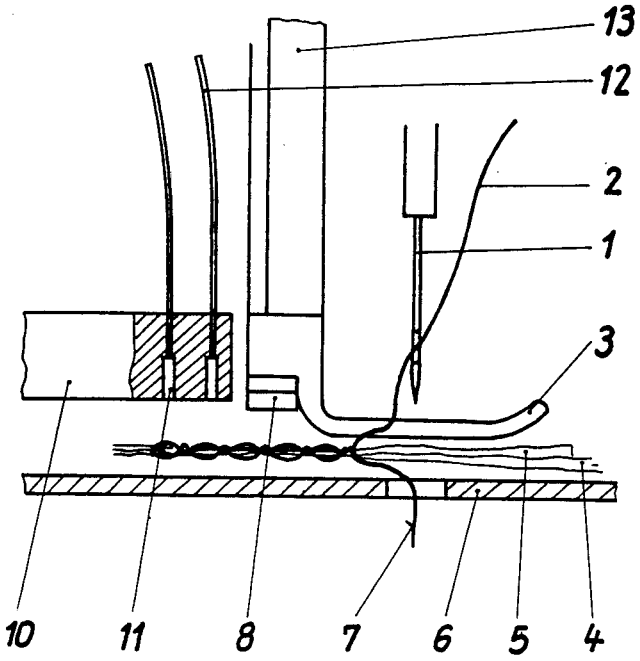
FIG. 2 is a side elevational view of the seaming point according to FIG. 1.
Figure 3:
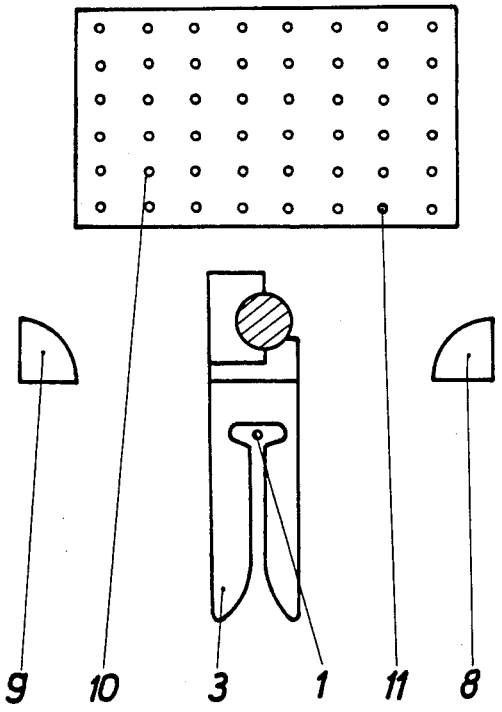
FIG. 3 is a top view of the seaming point according to FIG. 1.
Figure 4:
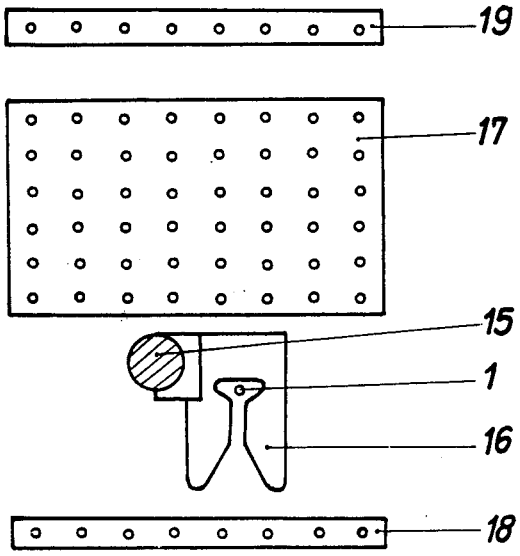
FIG. 4 is a top view of the seaming point according to FIG. 3 with transporting means and sewing goods.

An upper thread 2 is threaded into a needle 1. A nonvariable pressure foot 3 presses a lower fabric layer 4 and an upper fabric layer 5 onto a needle plate 6. The upper thread 2 and a lower thread 7 form the seam. Light emitters 8 and 9 are respectively located at the right and left sides relative to a foot retaining rod 13 maintained at its normal position. These light emitters operate in such a manner that they are actuated either right or left according to the position of a fabric edge 14 of the upper fabric layer 5. If, for instance, the double layer of fabric lies as in FIG. 1 at the left side of the needle 1, the right light emitter 8 radiates light. This is partially reflected upwardly at the fabric edge 14, whereby light beams frontally strike a light conducting cable 12 which is disposed in bores 11 in a detection head 10. In order to improve the directional effect of the arriving light beams, the light conducting cables 12 are arranged in the detection head 10 so that their frontal sides are fastened to the end of the bores 11 each bore 11 having a small diameter and a great length. In FIG. 4, a foot retaining rod 15 is illustrated in another position where a foot 16 is varied. This results in a detection head 17 to be more closely fastened to the place of the seam formation. An additional detection head 18 is fastened at the entrance of the sewing goods.

When long seam shapes are prepared which deviate only slightly from a straight line, a third detection head 19 is disposed at a suitable distance.

The detection heads 10, 17, 18, 19 are lowered close to sewing goods 20 at the beginning of seam 20*a* and are automatically lifted at the end of the sewing operation 20*c*.

For translucent sewing goods, light emitters are disposed underneath the needle plate 6 which comprises translucent material. A light emitting needle plate 6 may also be used.

Figure 5:
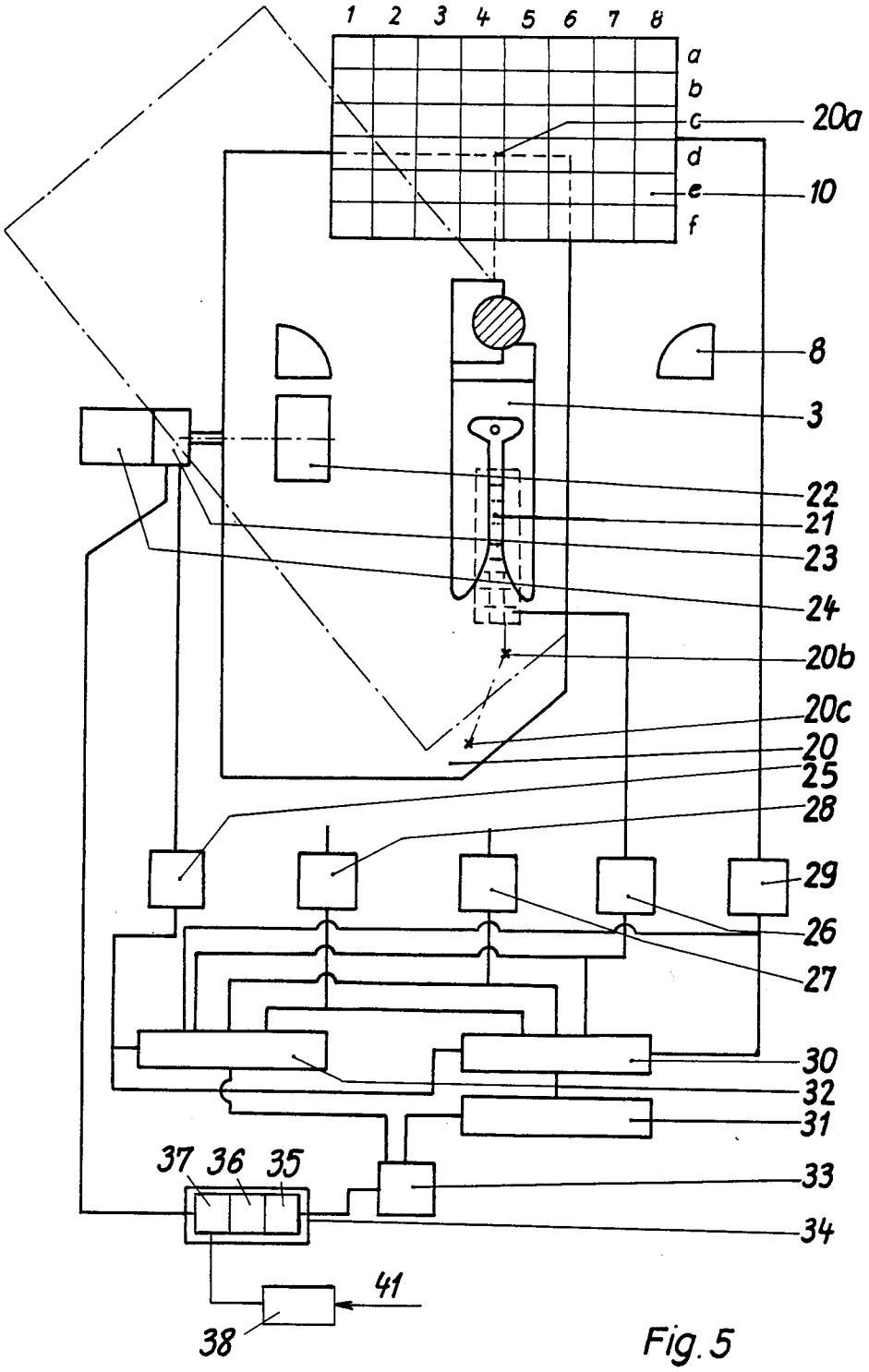
FIG. 5 is a block schematic of the seaming point for automatic sewing.

For automatic sewing (FIG. 5), the sewing goods 20 are at first manually sewed and the data thereof is stored in a memory 31. For this purpose, the sewing machine is switched to the production phase "take-up for programming". The sewing goods 20 are laid under the pressure foot 3 and the seam is started at 20*a*. The sewing goods 20 are fed by hand and are sewn up to point 20*b*. The detection head 10 detects the seam course by the bores 11 and delivers measuring data to the memory 31 through a scan detection 29 operating as a transducer. The detection head 10 operates as a sensor. The feed motion of the conventional sewing goods runs synchronously with the motion of the needle. The number of stitches, the size of a normal drive 21 and the positioning of the needle 1, are respectively fed to the memory 31 through a stitch counter 27, a measured value receiver 26 for normal drive and a measured value receiver 28 for the needle position. An advance device or an additional drive 22, which is preferably a pair of pinch rolls, and an incremental measured value receiver 23 are activated by the manually fed sewing goods 20. Data found by this method is also fed to the memory 31 by a measured value receiver 25 for the additional drive. When the needle 1 comes to a point 20*b* in the sewing goods 20, the sewing operation is interrupted, and the normal drive 21 is deactivated. The pressure foot 3 is lifted and the sewing goods 20 are manually turned around the needle 1. Additional data is thereby transferred to the memory 31 by the advance device 22. The edge of the sewing good with the completed seam located behind the needle 1 turns to the left to thereby cause light signals to fall upon additional boreholes 11 in the detection head 10. Only rows 7 and 8 of the detection head 10 receive light at point 20*b*, while at the end of the turn of the sewing goods in the present example, the boreholes a1 . . . 8, b2 . . . 8 c2 . . . 8 also receive light signals. That change is stored by the memory 31. When the sewing operation continues, each stitch causes a change with respect to the perception of a light signal, which is also stored. The aforedescribed process is repeated at point 20*c*.

When the manual sewing of the sewing goods 20 is complete, the machine is set to the stage "automatic sewing" for automatically sewing goods as in the manual sewing. At first, a known feed device for sewing goods transfers the goods to the starting stage 20*a*. The creation of a seam begins, wherein the detection head 10 detects an actual value which is transferred to the actual reference comparator 33. The reference input from the memory 31 is also entered to the comparator 33. The deviation between the reference and actual value is magnified in the seam shape regulator 34 and is used as a correcting value for the change of the rpm of the advance device 22, which is, for example, a step motor 24. After the registered number of stitches, the sewing goods 20 are turned at point 20*b* by the additional drive 22, in which the step motor 24 rotates until the actual reference comparator 33 detects a minimum deviation from the desired reference value. The sewing operation is continued until the stored program is completed.

The detection head 10 includes a radiation pick-up unit, which continuously converts the signals. Namely, variation of light brightness is processed by an electro-optical converter, in which a charge image is created by light incidence. When scanning a distribution of charge densities on the head 10, corresponding currents flow through an circuit external to the electro-optical converter, in which the variation of these currents denotes changes of sewing parameters. These analog values are registered and processed by a system, comprising the drive means of the step motor 24, the measured data receivers 30, 32, an analog-digital converter 35, an adapter 36, a microcomputer 37 and peripheral instruments 38. Information signals as well as control signals are transferred between these components of the system. They serve for observation and evaluation of the sewing parameters, the perception test for the measured data, the determination of the deviation from the stored data, the evaluation and output of the evaluated values, the control of the sewing process through the drive, for example through the step-motors and, when required, the output of information upon the display relating to the sewing operation.

We claim:

1. A device for regulating the shape of a seam on goods produced by a sewing machine, comprising at least one detection head on the sewing machine in the vicinity of a formation point of a seam, at least one light emitter arranged adjacent to the formation point of the seam, driving means on the sewing machine for transferring the goods while sewing, an information processing system concerning to said detection head and driving means so that when sewing information is stored in the information processing system at an information recording state, edge position of the goods detected by the detection head and movement of the goods detected by the driving means are memorized, and when an automatic sewing is performed, edge position of the goods actually sensed by the detection head is compared with the memorized value in the information processing system and goods being sewn are positioned and moved in accordance with the data detected at the information recording stage and stored in the information processing system, said information processing system comprising a first measured data receiver for manual guidance for receiving information from the driving means and the detection head at the information recording stage, a memory connected to the first measured data receiver for recording data at the information recording state, a second measured data receiver for automatic sewing for receiving information from the driving means and the detection head for the automatic sewing, a comparator for comparing the data in the memory and the data from the second measured data receiver, and a seam shape regulator connected to the comparator so that when there is a deviation between the data in the memory and the data from the second measured data receiver, the driving means is controlled to minimize the deviation.

2. A device according to claim 1, in which said driving means comprises a normal drive for transferring the goods to be sewn forwardly and backwardly, and an additional drive for changing direction of the goods, said additional drive including a step-motor, a pair of pinch rollers connected to the step-motor, and an incremental measured value receiver for the step-motor.

3. A device according to claim 2, in which said information processing system further comprises a first measured value receiver connected to the normal drive for measuring value of the normal drive, a second measured value receiver connected to the incremental measured value receiver of the additional drive for measuring value of the additional drive, a third measured value receiver for the needle position, a fourth measured value receiver connected to the detection head for detecting seam position of the goods, and a needle stitch counter, said first to fourth measured value receivers and the needle stitch counter being connected to the first measured data receiver at the information recording stage and to the second measured data receiver at the automatic sewing.

4. A device according to claim 3, in which said seam shape regulator comprises an analog-digital converter, an adapter, and a microcomputer for evaluating data from the comparator and operating the driving means.

5. A device according to claim 4, in which said information processing system further comprises peripheral components connected to the microcomputer.

6. A device according to claim 1, in which said detection head is a line or matrix CCD element.

7. A device according to claim 6, further comprising a translucent needle plate under the detection head, said light emitter being arranged under the needle plate.

8. A device according to claim 1, in which said detection head comprises a plurality of phototransistors for receiving light signals from said emitter.

9. A process for regulating the shape of a seam in a sewing machine, comprising:

preparing storable data of an ideal path of a seam continually equidistant to the edge of material being sewn by producing and storing first signals corresponding to said ideal path, sensing an actual path of a seam being produced by sensing said edge to produce second signals corresponding to actual seam shape data, comparing said first and second signals, and correcting said actual seam path to conform with said ideal path in response to said comparing step.

10. A process for regulating the shape of a seam in a sewing machine, comprising:

preparing storable data of an ideal path of a seam continually equidistant to the edge of material being sewn;

sensing an actual path of a seam being produced by sensing said edge to produce actual seam shape data;

comparing said actual data with said storable data, and correcting said actual seam path to conform with said ideal path;

said storable data being prepared by actually sewing goods by means of the sewing machine, sensing a path of the goods being sewn and storing data of the seam path.

11. A process according to claim 10, in which said sensing for the storable data and for the actual path comprise measuring value of a normal drive, measuring value of an additional drive, measuring value of a needle position, detecting seam position of the goods, and counting needle stitches on the goods being sewn.

12. A process according to claim 11, in which said detecting of seam position of the goods comprises emitting light adjacent the goods to be sewn and receiving light so that the seam position is detected.

13. A process according to claim 12, in which the data of the ideal path is used to regulate a plurality of sewing machines.

14. Apparatus for regulating the shape of a seam on goods produced by a sewing machine comprising:

means for preparing and storing first signals corresponding to an ideal path of a seam continually equidistant to the edge of the material being sewn, means for sensing an actual path of a seam being produced by sensing said edge to produce second signals corresponding to actual seam shape data, comparing means for comparing said first and second signals, and means responsive to said comparing means for correcting said actual seam path to conform with said ideal path.

* * * * *